US007469424B2

(12) United States Patent
Good et al.

(10) Patent No.: US 7,469,424 B2
(45) Date of Patent: Dec. 30, 2008

(54) PROTECTIVE BIB

(75) Inventors: Michele Annette Good, 6212 Yorkshire Ter., Bethesda, MD (US) 20814; Jennifer Ting Chow, Potomac, MD (US)

(73) Assignee: Michele Annette Good, Bethesda, MD (US)

( * ) Notice: Subject to any disclaimer, the term of this patent is extended or adjusted under 35 U.S.C. 154(b) by 0 days.

(21) Appl. No.: 11/873,528

(22) Filed: Oct. 17, 2007

(65) Prior Publication Data

US 2008/0092263 A1 Apr. 24, 2008

Related U.S. Application Data

(60) Provisional application No. 60/852,624, filed on Oct. 19, 2006.

(51) Int. Cl.
*A41B 13/10* (2006.01)
*A41D 13/04* (2006.01)

(52) U.S. Cl. ..... 2/49.1; 2/48

(58) Field of Classification Search ..... 2/49.1, 2/48, 51, 83, 72, 114, 46, 47, 49.2–49.5, 2/50, 52, 74, 75, 80, 105
See application file for complete search history.

(56) References Cited

U.S. PATENT DOCUMENTS 712,908 A * 11/1902 Clark ..... 2/51
1,018,078 A * 2/1912 Potter ..... 2/51
1,062,697 A * 5/1913 Daum ..... 2/51
1,462,515 A * 7/1923 McElroy ..... 2/72
1,489,046 A * 4/1924 Thompson ..... 2/114
1,783,572 A * 12/1930 Johnson ..... 2/72
2,520,026 A * 8/1950 Beitchman ..... 2/227
3,144,659 A * 8/1964 Matthews ..... 2/83
4,266,299 A * 5/1981 Beal ..... 2/46
4,718,122 A * 1/1988 Steverson ..... 2/70
D402,087 S * 12/1998 Scherich ..... D2/861
7,181,771 B1 * 2/2007 Naehu ..... 2/49.1
2006/0021106 A1 * 2/2006 Snodgrass ..... 2/48

* cited by examiner

*Primary Examiner*—Amy B Vanatta
(74) *Attorney, Agent, or Firm*—Lawrence E. Lambelet, Jr.

(57) ABSTRACT

Protective garments that can keep the front of the wearer's clothes clean and dry are provided. The bibs include a substantially overlapping slit formed in the center of a lower section of a front panel. The bibs with the slit are easy to put on and provide substantial coverage of frontal position of a wearer. The bibs can be used during eating, drinking, sitting, playing, crawling, etc. In some examples, the open back can enable the bib to be easily slipped on an already seated person without the need to stand. One or more bibs provide the ability to fasten the apron around each leg separately resulting in mobility and coverage, as well as the ability to use in seating where there is a vertical obstruction between the legs.

16 Claims, 5 Drawing Sheets

PROTECTIVE BIB

CROSS REFERENCE TO RELATED APPLICATIONS

This patent application claims the benefit of the filing date of U.S. Provisional Patent Application Ser. No. 60/852,624, filed Oct. 19, 2006 and entitled "OPEN-BACK, SLEEVED BIB/SMOCK WITH BISECTIONAL APRON," the entire contents of which are hereby expressly incorporated by reference.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

This invention relates to the field of protective garments. Specifically, this invention relates to a bib with a slit that can protect the wearers and/or their clothes.

2. Description of the Related Art

Bibs, smocks and aprons are typically used as protective garments to be worn generally over other clothing. Bibs, aprons and smocks provide protection to the wearer's chest and torso. Bibs are frequently used by children but also by some adults. Bibs can be made of cloth, plastic or any other suitable material. Bibs may be disposable or washable, and generally cover the chest. However, bibs, aprons and smocks generally may not protect the wearer's arms, legs or lap.

The following are some of the patents that disclosed protective garments such as bibs, aprons, and other similar garments.

U.S. Pat. No. 3,995,321 disclosed a disposable protective bib with a pocket member to catch spilled and dropped food.

U.S. Pat. No. 4,301,544 disclosed an apron assembly which can attach to the edge of a tray and form a pocket.

U.S. Pat. No. 5,201,073 disclosed a combination bib and toy with a storage pocket.

U.S. Pat. No. 5,476,697 disclosed a paper napkin with adhesive surfaces and intended to protect clothing from spillage.

U.S. Pat. No. 5,490,289 disclosed a baby bib consisting of two panels, one of which is of elongated construction and closes about the neck of the wearer, and the other panel is made of absorbent material and may be mounted on the first panel.

U.S. Pat. No. 5,491,844 disclosed a plurality of disposable bib panels attached to form a pad of panels that can be dispensed by peeling the top panel from the one below it.

U.S. Pat. No. 5,640,715 disclosed a protective garment which can be moved between a folded up position and a folded down position.

U.S. Pat. No. 7,181,771 disclosed a garment consisting of two pieces which protects a child's clothing from food and drink spills. A back flap protects the upper back and shoulders of the child and a lower piece covers the arms, body and most of the legs of the child.

U.S. Pat. No. 7,178,170 disclosed a lap bib consisting of a lap portion and an abdomen portion which protects the user while eating.

U.S. Pat. No. 5,075,897 disclosed a protective garment which protects the wearer's lap and chest and is worn using a strap from the neck.

Although the patents described above provide many advantages, many of these still require the bib to be worn before the individual who is wearing them is seated. Also, many of these do not provide optimal coverage and protection to the wearer's arms, shoulders, torso and lap while enabling an individual who is seated to wear this garment with ease.

It is therefore desirable to have bibs that optimally cover and protect the substantial areas of one or more of wearer's arms, shoulders, torso and lap while at the same time enabling the bibs to be worn easily even when the individual wearing the bib is already seated.

BRIEF SUMMARY OF THE INVENTION

The following presents a simplified summary of the invention in order to provide a basic understanding of some aspects of the invention. This summary is not an extensive overview of the invention. It is not intended to identify key/critical elements of tie invention or to delineate the scope of the invention. Its sole purpose is to present some concepts of the invention in a simplified form as a prelude to the more detailed description that is presented later.

A bib comprising a panel with a neck section, middle section and lower section having a slit, according to an embodiment of the present invention, provides a garment capable of protecting substantial portions of one or more of the arms, chest, legs and lap portions of a wearer and/or a wearer's garments while providing for easy wearing of the garment. In some embodiments of the invention, the neck section covers the wearer's chest and the area around the wearer's neck. The middle section of the garment substantially protects the length of the wearer's torso approximately beginning at the wearer's chest and extending to his waist. The lower section of the garment substantially protects the wearer's lap extending from his waist to the wearer's thighs. In other embodiments of the present invention, the bibs can be worn by a seated individual or worn by an individual who is already seated. The bib covers a seated person, whether an infant or adult, or one moving around.

In one aspect of the present invention, a bib is described that includes a slit perpendicular to the bottom of the lower section of the panel of the bib extending between ⅓ and ⅔ of the length of the panel toward the middle section, forming a lower right section and a lower left section each having an outer end and an inner end to accommodate a seat with a vertical obstruction between the legs e.g., high chair. The lower right section and the lower left section can be fastened separately around each leg for optimal leg and lap protection. This embodiment also allows the wearer to be protected even when in movement without the possibility of the bib sliding from side to side.

In another embodiment, the bib can form a single closed apron by fastening the outer end of the lower right section to the outer end of the lower left section and fastening the inner end of the lower right section to the inner end of the lower left section.

The bib can be made with long, medium, short or no sleeves. Various attachment methods may be used to attach the bib around the wearer's neck, legs, and lap, as well as the sleeves to make them more tight fitting to protect the garments underneath from getting soiled or wet.

To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

BRIEF DESCRIPTION OF THE DRAWINGS

There are five drawings included.

FIG. 1 is a pattern piece, showing one possible embodiment of the invention.

FIG. 2A is a frontal perspective of a closed garment, according to one possible embodiment of the invention.

FIG. 2B is a rear perspective of a closed garment, according to one possible embodiment of the invention.

FIG. 3A is a frontal perspective of an open garment, according to one possible embodiment of the invention.

FIG. 3B is a rear perspective of an open garment, according, to one possible embodiment of the invention.

DETAILED DESCRIPTION OF THE PREFERRED EMBODIMENT

The following is a detailed description of some exemplary embodiments of the invention(s) contained within the disclosed subject matter. Such invention(s) may be referred to, individually and/or collectively, herein by the term "invention" merely for convenience and without intending to voluntarily limit the scope of this application to any single invention or inventive concept if more than one is, in fact, disclosed. In the detailed description, reference is made to the accompanying drawings that form a part hereof, and in which are shown, by way of illustration, but not of limitation, some specific embodiments of the invention, including a preferred embodiment. These embodiments are described in sufficient detail to enable those of ordinary skill in the art to understand and implement the inventive subject matter. It is to be understood that other embodiments may be utilized, and that changes may be made without departing from the scope of the inventive subject matter.

The present invention relates to bibs that can protect substantial portions of one or more of the arms, chest, torso, legs and lap of the wearer. Further, one or more embodiments of the present invention enable a wearer or a helper to place the bibs while the wearer is in seated position. One or more embodiments of the present invention disclose a bib with a slit perpendicular to the bottom of the panel and extending toward the middle section such that it would accommodate a seat with a vertical obstruction between the legs, e.g., high chair.

For purposes of this patent application the term "bib" is intended to include smock, apron, coverall, and other similar or equivalent garments used to keep the wearer's clothes clean and dry.

In one aspect of the invention, a bib with a slit perpendicular to the bottom of the panel is described that can protect a wearer's legs and lap. The bibs of the present invention can be made by machine or by hand. The bib described here can be made with different types of fabrics such as water-resistant, absorbent, disposable, animal, plant, mineral, synthetic, rayon, polyester, wool, linen, nylon, cotton, acrylic, acetate, aramid, olefin, ingeo or a combination thereof. In some embodiments of the invention, the bibs of the present invention are hand or machine made and can be wiped clean, machine washed, disposed, etc. when it is soiled or whenever it needs cleaning.

Figure 1:
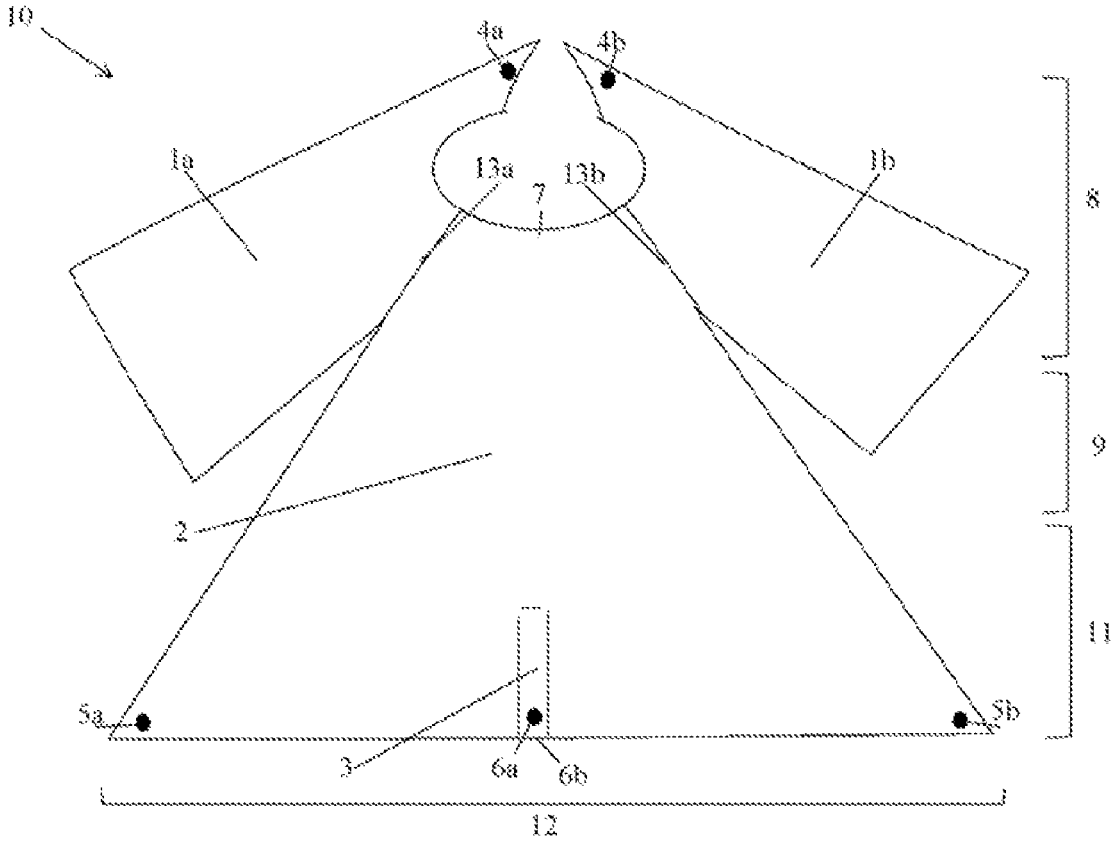
FIG. 1, FIG. 2A, FIG. 2B, FIG. 3A and FIG. 3B. All numbers in the drawings that are italicized are on the under side of the closure.

In an embodiment of this aspect of the invention illustrated in FIG. 1, the bib 10 comprises a panel that includes a neck section 8, middle section 9 and lower section 11. It is to be appreciated that the panel sections are only intended for helping the description. The lower section 11 of panel 2 is generally wider than the neck section 8 and the middle section 9 such that the lower section can wrap around the legs and lap of the wearer. The shape of the panel 2 can be triangular, bell, or other shapes so as to provide the wearer optimal protection from spills and being soiled and also to accommodate the wearer's legs.

In one embodiment of this invention, the neck section 8 substantially covers the area around the wearer's neck and extends to the wearer's chest. At the top of the neck section 8 is a collar 7 and a pair of openings for sleeves 13*a* & 13*b*. Extending substantially laterally from the pair of openings for sleeves 13*a* & 13*b* in the neck section 8 in an embodiment of the invention is a pair of sleeves 1*a* & 1*b*. The middle section 9 substantially protects the wearer's torso beginning at the wearer's chest and extends to the wearer's waist. The lower section 11 covers the wearer's waist and extends to protect the wearer's thighs. The lower section 11 shows a substantially overlapping slit 3 extending from bottom 12 of the lower section 11 toward the middle section 9 of the panel 2. This embodiment of the invention shows fastening elements 4*a* & 4*b* attached to the collar 7 for fastening the collar around the wearer's neck, fastening elements 5*a* & 5*b* located at the outer ends of the lower right section and the lower left section to fasten these ends; and fastening elements 6*a* & 6*b* located at the inner ends of the lower right section and lower left section to fasten these ends and form a single closed bib. When the bib 10 forms a single closed bib, the overlapping slit 3 protects the wearer's clothes from spilled food and drink. In this embodiment of the present invention, the slit 3 is substantially overlapping and can accommodate a seat with a vertical obstruction between the legs, e.g., a high chair, by fastening the outer and inner ends of the lower right section around the wearer's right leg and the outer and inner ends of the lower left section around the wearer's left leg to form an open bib.

In some other embodiments of the invention the sleeves 1*a* & 1*b* of the bib 10 can be made with long, medium or short sleeves. Long sleeves would cover whole arm to the wrist. Medium sleeves would cover 50-75% of the arm. Short sleeves would cover less than 50% of the arm. The bib 10 also can be made without sleeves. In some embodiments, the sleeves 1*a* & 1*b* can be made tight fitting to prevent soiling or wetting the wearer's garments or may remain open. The end of the sleeves 1*a* & 1*b* can be tightly enclosed through the use of elastic bands, buttons, snaps, ties, hooks, loops, magnets, adhesives or other tightening methods.

In some embodiments of the invention, the panel 2 can be made in various lengths such as full length (to the wearer's ankle or covering feet), medium length (to the wearer's shin) or short length (to the wearer's knee). The panel 2 and sleeves 1*a* & 1*b* can be made of either the same material or can be made of different materials. The panel 2 and the sleeves 1*a* & 1*b* can be made from a single piece of material or can be made from different pieces of materials. In some embodiments the panel 2 can be made from a combination of materials with an identical design or different designs.

In further embodiments of the invention, the bib 10 can utilize a single or multiple collar 7 fastening elements 4*a* & 4*b* to accommodate the growing size of the wearer or multiple wearers. The collar 7 fastening elements 4*a* & 4*b* can take the form of buttons, snaps, ties, hooks, loops, magnets, adhesives or other closure methods. The collar 7 formed at the neck section 8 of the panel 2 can be made in various shapes such as a round, square, oval etc. and functions to protect tie wearer's underlying garments. In some embodiments of the invention, the collar 7 can be continuous resulting in an opening through which a wearer can place their head.

Figure 2A:
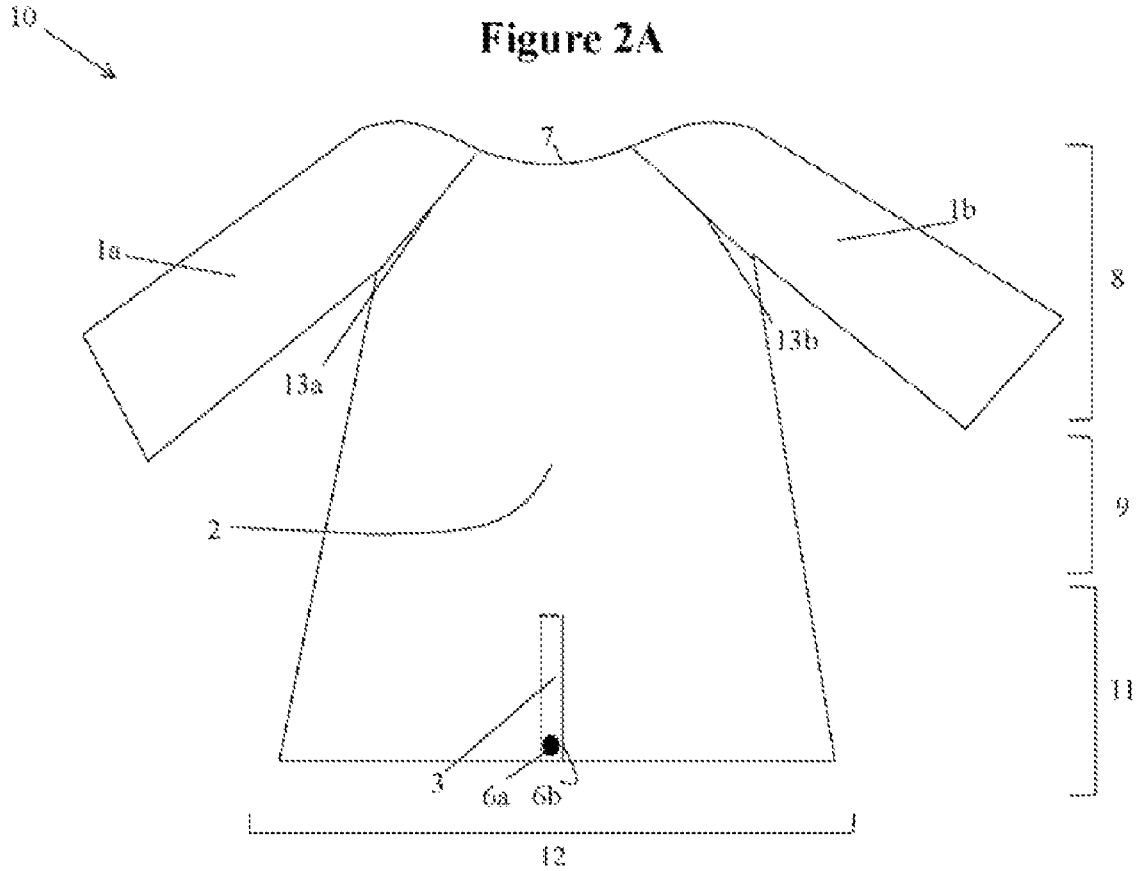

In one embodiment of the present invention, the bib 10 is made to cover the wearer's lap, torso, chest, legs and arms, and can be secured in two different ways. FIG. 2A shows a front view of the bib 10 as a single closed bib, one embodiment of the invention. The bib 10 can be closed as a single closed bib by fastening the fastening elements 5*a* & 5*b* located at the outer ends of the lower right section and the lower left section and fastening the fastening elements 6*a* & 6*b* located at the inner ends of the lower right section and lower left section.

Figure 2B:
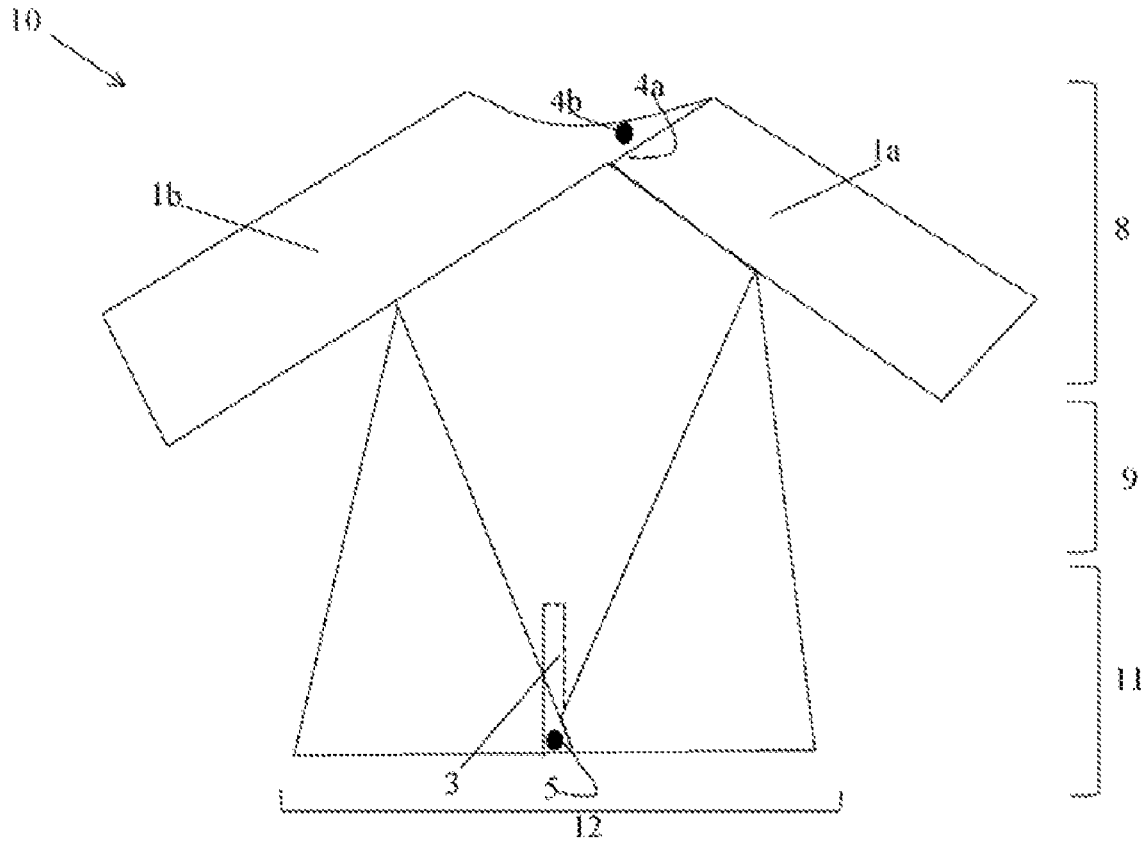

FIG. 2B shows a back view of the bib 10 when closed as a single bib as illustrated in FIG. 2A, according to one embodiment of the invention. The back of the bib when closed as a single bib by fastening the fastening elements 5*a* & 5*b* located at the outer ends of the lower right section and the lower left section behind the legs of the wearer. In some examples, the back of the bib can be left open by keeping area 5*a* & 5*b* unfastened.

Figure 3A:
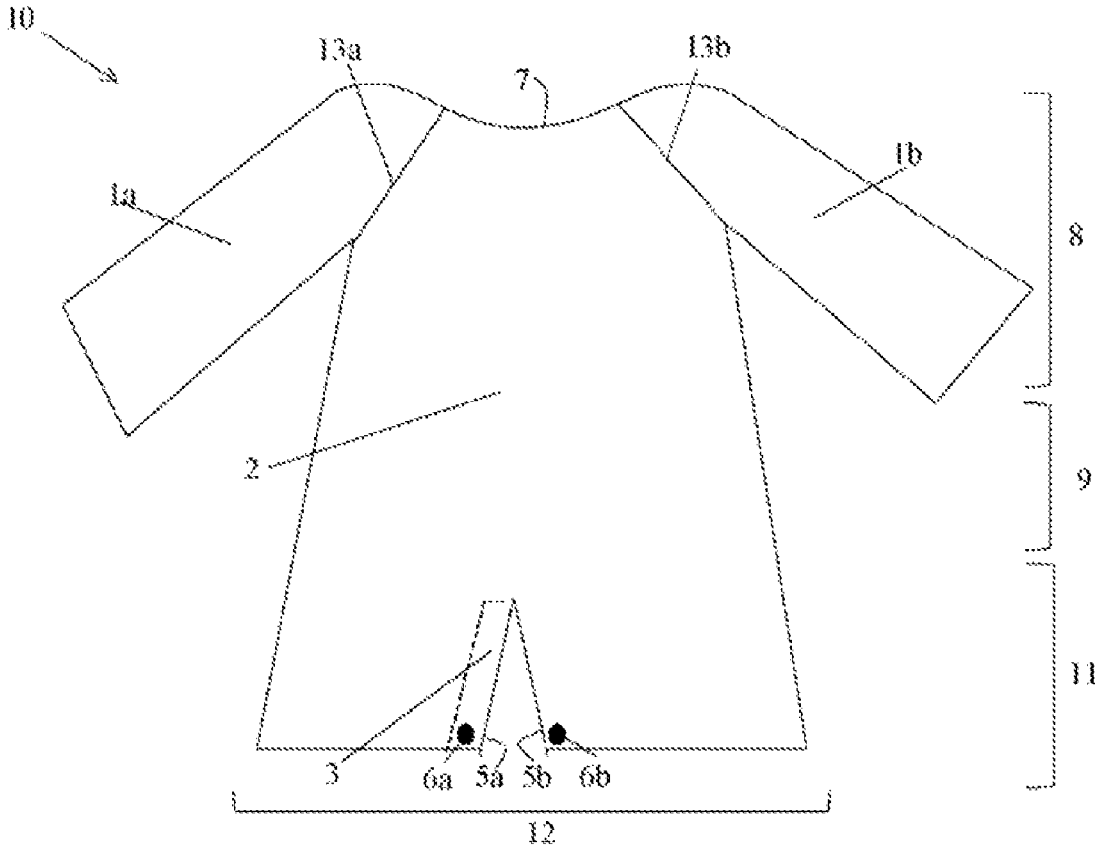

FIG. 3A shows a front view of an open bib 10 according to another embodiment of the invention achieved as a result of another way of securing the bib 10. The slit 3 can be used to form an open bib by fastening the outer and inner ends of the lower right section around the wearer's right leg with fastening elements 5*b* & 6*b* and the outer and inner ends of the lower left section around the wearer's left leg with fastening elements 5*a* & 5*b* to form an open bib.

Figure 3B:
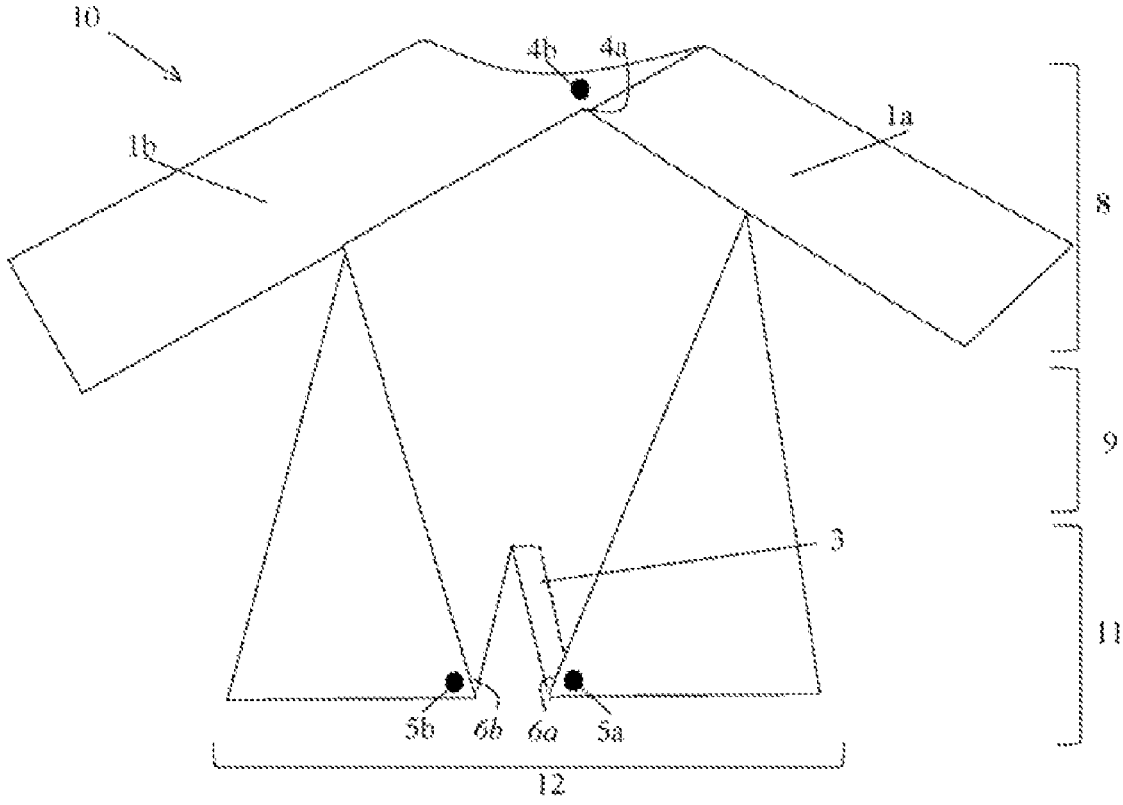

FIG. 3B shows a back view of the bib 10 with panel 2 in an open bib position as illustrated in FIG. 3A. FIG. 3B shows the outer and inner ends of the lower right section fastened around the wearer's right leg with fastening elements 5*b* & 6*b* and the outer and inner ends of the lower left section fastened around the wearer's left leg with fastening elements 5*a* & 5*b* to form the back view of an open bib.

The open bib 10 and the slit 3 shown in FIGS. 3A & 3B can accommodate a seat with a vertical obstruction between the legs of the wearer, e.g., high chair. The open bib 10 and the slit 3 as shown in FIGS. 3A & 3B can enable the wearer to put the bib on while seated in a chair, high chair, wheelchair, etc. rather than requiring the wearer to stand to put on the bib.

It is to be appreciated that a person skilled in the art would be able to alter the position of the fasteners and the nature of fasteners without deviating from the scope of the present invention and therefore, any and all of these changes are intended to be within the scope the present invention. The bib 10 can be made with various leg, slit 3 and collar 7 fasteners (5*a* & 5*b*, 6*a* & 6*b*, 4*a* & 4*b*) such as buttons, snaps, ties, hooks, loops, magnets, adhesives or other fastening methods. The bib can utilize a single or multiple leg, slit 3 and collar 7 fastening elements (4*a* & 4*b*, 5*a* & 5*b*, 6*a* & 6*b*) to accommodate the growing size of the wearer or multiple wearers.

The bibs of the present invention can be made as single units or multiple units based on the need. In cases where the bibs are manufactured as multiple units, each bib is separated from the others by using any known means including perforation that can be torn apart. Even though the above description is focused on bibs, the present invention can be easily adapted to manufacture other types of protective garments such as smocks, aprons, coveralls and the like.

It is emphasized that the Abstract is provided to comply with laws and regulations requiring an Abstract that will allow the reader to quickly ascertain the nature and gist of the technical disclosure. It is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate preferred embodiment.

It will be readily understood to those skilled in the art that various other changes in the details, material, and arrangements of the parts and method stages which have been described and illustrated in order to explain the nature of this invention, may be made without departing from the principles and scope of the invention as expressed in the subjoined claims. Accordingly, it is intended that the invention be limited only to the extent required by the appended claims and the applicable rules of law.

What is claimed is:

1. A protective bib formed from an essentially triangular panel of material, comprising:

a neck section substantially covering the upper torso of an intended wearer having a collar edge truncating the panel at the narrow end and intersecting with two flanking sleeve edges at the two sides of the panel, whereat two collar straps extend bilaterally from the intersections, each strap having one of a complementary set of fasteners at the end thereof to secure a collar around the neck of the wearer;

a middle section substantially covering the lower torso of the wearer; and a lower section substantially covering the lap of the wearer having a lower edge at the wide end of the panel, the lower edge being divided by a perpendicular slit extending substantially to the middle section, the slit dividing the lower section into a lower right portion and a lower left portion, each portion having one of a complementary set of fasteners at the interior and exterior corners thereof, the interior corners of the two portions sharing one of the complementary set of fasteners, the fastener array providing for selectively joining the portions together at the slit or individually joining each portion onto itself at the corners.

2. The protective bib of claim 1, wherein the complementary set of fasteners is selected from the group consisting of buttons and button holes, male and female snaps, ties, hooks and loops, hook and loop fibrils, magnets of opposite poles, zippers and adhesives.

3. The protective bib of claim 1 further comprising sleeves joined with the neck section at the sleeve edges for substantially covering the arms of the intended wearer.

4. The protective bib of claim 1, wherein the slit comprises an overlapping flap such that a gap in the slit is prevented when the interior fasteners are joined together.

5. The protective bib of claim 1, wherein the fasteners of the lower section are configured to cover the lap of the wearer by joining the two interior corners.

6. The protective bib of claim 1, wherein the fasteners of the lower section are configured to enclose each of the legs of the wearer individually by joining the interior and exterior corners of each portion.

7. The protective bib of claim 1, wherein the panel is comprised of a water-resistant material or coated with a water-resistant substance.

8. The protective bib of claim 3, wherein the sleeves and the essentially triangular panel are integrally formed from a common sheet of material.

9. The protective bib of claim 1, wherein a smock, apron or coverall a smock is formed by joining interior and exterior fasteners together.

10. The protective bib of claim 1 wherein the panel is comprised of a disposable material.

11. The protective bib of claim 1 wherein an apron is formed by joining the interior fasteners together.

12. The protective bib of claim 1 wherein a coverall is formed by individually joining the lower right portion fasteners together and the lower left portion fasteners together.

13. A method for making a protective bib comprising the steps of:

selecting a material composition;

generating a substantially triangular panel of material therefrom having neck, middle and lower sections, wherein a neck section has a neck edge truncating the narrow end of the panel and two collar straps extending bilaterally from the intersections of the neck edge with sleeve edges at the adjoining sides of the panel;

forming a slit in the lower section perpendicular to a lower edge of the wide end of the panel and extending to substantially the middle section thereby dividing the lower section into a lower right portion and a lower left portion;

affixing one of a complementary set of fasteners to each end of the collar straps thereby to secure the protective bib to the neck of the intended wearer; and affixing one of the complementary set of fasteners to each of the corners of the lower right portion and the lower left portion to selectively form a lap cover with the interior corners or individual leg covers with the interior and exterior corners of each portion.

14. A method for using a protective bib comprising the steps of:

providing the protective bib of claim 1;

securing the collar straps around the neck of the wearer with the fasteners;

fastening the interior and exterior corners of the lower right portion of the lower section around a first leg of the wearer; and fastening the interior and exterior corners of the lower left portion of the lower section around a second leg of the wearer.

15. The method of claim 14 wherein application of the protective bib is made to an already seated wearer.

16. The method of claim 14 wherein the slit facilitates using a seat with a vertical obstruction positioned between the legs of the wearer.

* * * * *